US006047437A

United States Patent [19]

Suzuki

[11] Patent Number: 6,047,437

[45] Date of Patent: Apr. 11, 2000

[54] SQUEEGEE ASSEMBLY FOR SCRUBBER

[75] Inventor: Masato Suzuki, Miyakoda, Japan

[73] Assignee: Amano Corporation, Yokohama, Japan

[21] Appl. No.: 08/966,032

[22] Filed: Nov. 7, 1997

[30] Foreign Application Priority Data

Jan. 31, 1997 [JP] Japan ..... 9-033146

[51] Int. Cl.[7] ..... A47L 9/06

[52] U.S. Cl. ..... 15/401; 15/320; 15/245; 15/420

[58] Field of Search ..... 15/320, 401, 245

[56] References Cited

U.S. PATENT DOCUMENTS

| | | | |
|---|---|---|---|
| 930,134 | 8/1909 | Blackall | 15/401 |
| 3,571,841 | 3/1971 | Crouser | 15/401 |
| 4,817,233 | 4/1989 | Waldhauser | 15/401 X |
| 5,280,666 | 1/1994 | Wood et al. | 15/401 |
| 5,911,260 | 6/1999 | Suzuki | 15/401 |

FOREIGN PATENT DOCUMENTS

| | | | |
|---|---|---|---|
| 1271508 | 8/1961 | France | 15/401 |

*Primary Examiner*—Chris K. Moore
*Attorney, Agent, or Firm*—Stevens, Davis, Miller & Mosher, L.L.P.

[57] ABSTRACT

A squeegee assembly which includes a laterally elongated cover body, one pair of flexible front and rear blades forwardly/backwardly spacedly arranged in parallel relation on the cover body, and a blower for applying a sucking function to an interval between the pair of blades so that a dirty liquid gathered by the one pair of flexible blades is sucked up from a floor surface for collection, wherein a lower side portion of the front side flexible blade is bent horizontally towards the rear side flexible blade thereby to form a contacting surface, a distal end side thereof is raised such that a small opposing space is formed between the rear side flexible blade and the front side flexible blade and secured to the cover body side, thereby defining a suction chamber, on which the sucking force of the blower is prevailed, at a lower side of the cover body, a plurality of concave or wedge-shaped guide grooves are formed in a bottom surface of the horizontally bent contacting surface, and a dirty liquid sucking cavity for intercommunicating the suction chamber and the opposing space is formed in a surface of the raised portion.

2 Claims, 8 Drawing Sheets

SQUEEGEE ASSEMBLY FOR SCRUBBER

BACKGROUND OF THE INVENTION

1. Field of the Invention

This invention relates to a floor surface cleaning machine called a "scrubber" for cleaning the surface of a floor by brushing it with a brush while traveling thereon, and more particularly, it relates to an improvement of a squeegee assembly, in which a dirty liquid remaining on the floor surface after the floor surface is cleaned by a brush is sucked up, under the effect of a sucking function of a blower, from the floor surface for collection.

2. Brief Description of the Related Art

A conventional scrubber employs a squeegee assembly, which is known to comprise, as shown for example in Japanese Utility Model Laid-Open Publication Nos. 38848/1994, 79454/1994, and 58853/1994, two front and rear flexible blades spacedly arranged in parallel opposing relationship.

FIG. 17 shows a construction of the above-mentioned conventional squeegee assembly. In the Figure, reference character Sk denotes a case body on which the sucking effect of the blower acts; SX, an inlet port thereof; Ra, Rb, a front and a rear flexible blade (rubber plate) spacedly attached to the inside of the case body SK at a front and a rear portion thereof; F, a floor surface consisting of tiles T; and M, a joint portion between the adjacent tiles T, respectively.

The conventional squeegee assembly thus constructed has such shortcoming that in case the tiles T are of the type that the joint portion M is formed between the adjacent tiles T, when the flexible blades Ra, Rb are caught by the joint portion M, air is overly taken through the joint portion M to reduce the air sucking speed and as a result, dirty liquid remaining in the joint portion M can not be sucked.

Moreover, since the above conventional squeegee assembly is designed such that dirty liquid is scraped off the floor surface by the pair of front and rear flexible blades Ra, Rb each formed of a comparatively thick rubber plate, in case the floor surface F to be cleaned has irregularities such as the tiles T including the joint portion M as shown in FIG. 17, the flexible blades Ra, Rb can not properly follow the irregular surface of the floor and as a result, spaces are formed between the flexible blades Ra, Rb and the floor surface, thereby allowing dirty liquid or a cleaning trace to remain on the floor surface to be cleaned.

To overcome the above shortcomings, some attempts are made in order to increase the sucking force of dirty liquid by increasing the air sucking speed by means of reducing the space between the front and rear flexible blades Ra, Rb.

However, those attempts are not successful because the actual time for the squeegee assembly to pass the joint portion M between the adjacent tiles T is extremely short and therefore, in case the space between the front and rear flexible blades Ra, Rb is reduced, the time required for the squeegee assembly to pass the joint portion M becomes shorter. This makes it almost impossible to suck dirty liquid remaining in the joint portion M in an accelerated manner by a suction air stream towards the squeegee assembly side. As a consequence, the collection efficiency of dirty liquid becomes so poor that dirty liquid can not be sucked completely by a single attempt of suction.

The present invention has been accomplished under the above-mentioned circumstance.

SUMMARY OF THE INVENTION

It is, therefore, an object of the present invention to provide a squeegee assembly to be used in a scrubber, in which not only the dirty liquid remaining on the floor surface but also the dirty liquid remaining inside the joint portion of the tiles, etc. can be completely removed.

In order to achieve the above object, there is provided a squeegee assembly for a scrubber comprising a laterally elongated cover body, one pair of flexible front and rear blades forwardly/backwardly spacedly arranged in parallel relation on the cover body, and a blower for applying a sucking function to an interval between the pair of blades so that a dirty liquid gathered by the one pair of flexible blades is sucked up from a floor surface for collection, (1) wherein: wherein a lower side portion of the frond side flexible blade is bent horizontally towards the rear side flexible blade thereby to form a contacting surface, a distal end side thereof is raised such that a small opposing space is formed between the rear side flexible blade and the front side flexible blade and secured to the cover body side, thereby defining a suction chamber, on which the sucking force of the blower is prevailed, at a lower side of the cover body, a plurality of guide grooves are formed in a bottom surface of the horizontally bent contacting surface, and a dirty liquid sucking cavity for intercommunicating the suction chamber and the opposing space is formed in a surface of the raised portion;

(2) wherein: the cover body is provided at a central portion thereof with an air ventilating port on which the sucking force of the blower is prevailed in a concentrated manner, the guide grooves formed in the contacting surface of the front side flexible blade are slanted or inclined towards a center line of the dirty liquid sucking cavity; and rearward end ports of the guide grooves are opened towards or communicate with the dirty liquid sucking cavity formed at the raised portion of the front side flexible blade;

(3) wherein: the cover body is provided at a central portion thereof with an air ventilating port on which the sucking force of the blower is prevailed, the raised portion of the front side flexible blade is provided at a central portion thereof with a dirty liquid sucking cavity, the guide grooves formed in the bottom surface of the contacting surface of the front side flexible blade are slanted or inclined towards the a center line of the dirty liquid sucking cavity, a laterally elongated collecting groove, a forward end port of which is opened to be in communication with the dirty liquid sucking cavity formed in the central portion, is formed in an outside surface of the raised portion of the front side flexible blade, and the rearward end ports of the guide grooves are opened to be in communication with the collecting groove or the dirty liquid sucking cavity;

(4) wherein: the guide grooves formed in the bottom surface of the contacting surface of the front side flexible blade are each enlarged in width at the forward end port side and reduced in width at the rearward end port side;

(5) wherein: the guide grooves are each shallow on the forward port side where the width is enlarged, and deep on the rearward end port side where the width is reduced, so that each of the guide grooves becomes the same in overall sectional area;

(6) wherein: a lower side portion of the frond side flexible blade is bent horizontally towards the rear side flexible blade thereby to form a contacting surface, a distal end side thereof is raised such that a small opposing space is formed between the rear side flexible blade and the front side flexible blade and secured to the cover body side, thereby defining a suction chamber, on which the sucking force of the blower is prevailed, at a lower side of the cover body, a plurality of guide ridges are formed in a bottom surface of the horizontally bent contacting surface in parallel relation in a forward and backward direction, and a dirty liquid sucking cavity for intercommunicating the suction chamber and the opposing space is formed in a surface of the raised portion;

(7) wherein: the cover body is provided at a central portion thereof with an air ventilating port on which the sucking force of the blower is prevailed in a concentrated manner, the guide ridges formed in parallel relation on the bottom surface of the front side flexible blade are slanted or inclined towards the a center line of the dirty liquid sucking cavity and rearward end spaces of the guide ridges are opened towards to be in communication with the dirty liquid sucking cavity formed at the raised portion of the front side flexible blade;

(8) wherein: a lower side portion of the frond side flexible blade is bent horizontally towards the rear side flexible blade thereby to form a contacting surface, a distal end side thereof is raised such that a small opposing space is formed between the rear side flexible blade and the front side flexible blade and secured to the cover body side, thereby defining a suction chamber, on which the sucking force of the blower is prevailed, at a lower side of the cover body, a plurality of protrusions are spacedly formed in a bottom surface of the horizontally bent contacting surface in parallel relation in vertical and horizontal directions, and a dirty liquid sucking cavity for intercommunicating the suction chamber and the opposing space is formed in a surface of the raised portion;

(9) wherein: the protrusions formed on the horizontally bent contacting surface of the front side flexible blade are projected towards the floor surface;

(10) wherein: the protrusions formed on the horizontally bent contacting surface of the front side flexible blade are formed by recessing those areas of the contacting surface nearby the protrusions; and

(11) wherein: the suction chamber defined by the horizontally bent portion of the lower side portion of the front side flexible blade and the raised portion of the front side flexible blade is provided therein a guide plate for guiding the sucking force of the blower towards the dirty liquid sucking cavity formed in a central portion of the raised portion.

① According to the feature described in the above item (1), since the sucking force of the blower acts on the small space between the raised portion of the front side flexible blade and the rear side flexible blade from the dirty liquid sucking cavity through the suction chamber, the sucking air speed is increased and therefore, the sucking force can be increased. Since the bottom surface of the horizontally bent contacting surface of the front side flexible blade is contacted at its wide area the floor surface to increase the sealing performance, the time of the front side flexible blade for contacting the floor surface is long enough. As a consequence, the dirty liquid can be completely sucked towards the small space between the rear side flexible blade and the raised portion of the front side flexible blade. Thus, even the dirty liquid remaining in the joint portion between the adjacent tiles can easily be sucked by a single sucking operation.

② According to the feature described in the above item (2), since the dirty liquid remaining on the floor surface can be guided, in a concentrated manner, towards the sucking cavity formed in the central portion of the cover body along the guide grooves slanted or inclined towards the central portion of the cover body, the dirty liquid can efficiently be collected through the dirty liquid sucking cavity formed in the raised portion of the front side flexible blade.

③ According to the feature described in the above item (3), since the sucking force of the blower is concentrated on the dirty liquid sucking cavity formed in the central portion of the cover body and the dirty liquid remaining on the floor surface is sucked, in a concentrated manner, towards the dirty liquid sucking cavity by the inclined guide grooves formed in the bottom surface of the contacting surface of the front side flexible blade, the dirty liquid remaining on the floor surface as well as the dirty liquid remaining in the joint portion between the adjacent tiles can be totally sucked by this powerful sucking force in a reliable manner.

④ According to the feature described in the above item (4), since the guide grooves formed in the bottom surface of the contacting surface of the front side flexible blade which contacts the floor surface is enlarged in width at its forward end port side, so that the dirty liquid can easily be flown therein, the forward end ports of the guide grooves are not choked with dusts, hair, etc. contained in the dirty liquid, and those dusts, hair, etc. can immediately sucked towards the dirty liquid sucking cavity side so that they can be sucked together with the dirty liquid.

⑤ According to the feature described in the above item (5), each guide groove formed in the bottom surface of the contacting surface of the front side flexible blade which contacts the floor surface is shallow on the forward port side where the width is enlarged, and deep on the rearward end port side where the width is reduced, so that each guide groove including the forward end port and the rearward end port becomes the same in overall sectional area, the flowing speed of the dirty liquid flowing through the interior of each guide groove is the same at the inlet port as at the outlet port. As a consequence, the sucking efficiency can be increased without increasing sucking resistance.

⑥ According to the feature described in the above item (6), the sucking force can be increased by increasing the sucking air speed by the blower as in the above item ①. In addition, the dirty liquid guided by each guide ridge can completely sucked into the small space between the rear side flexible blade and the raised portion of the front side flexible blade.

⑦ According to the feature described in the above item (7), the dirty liquid can be sucked, in a concentrated manner, towards the sucking cavity for collection along the inclined guide ridges as in the above item ②.

⑧ According to the feature described in the above item (8), the sucking force can be increased by increasing the sucking air speed by the blower, as in the above items ① through ⑥. In addition, the dirty liquid can completely be sucked into the small space between the rear side flexible blade and the raised portion of the front side flexible blade.

(9) According to the features described in the above items (9) and (10), since a plurality of protrusions are spacedly arranged on the horizontally bent contacting surface of the front side flexible blade in both vertical and lateral directions so that the distal end faces of the protrusions are directly contacted with the floor surface, the dirty liquid remaining on the floor surface can be sucked towards the dirty liquid sucking cavity through spaces among the protrusions.

(10) According to the feature described in the above item (11), since the sucking force of the blower acting on the interior of the suction chamber is guided, in a concentrated manner, into the dirty liquid sucking cavity formed in the raised portion of the front side flexible blade, the sucking performance can be extensively increased by increasing the sucking air speed by prevailing the extremely powerful sucking effect on the small space between the rear side flexible blade and the raised portion in a concentrated manner.

A more complete application of the invention and many of the attendant advantages thereof will be readily obtained as the same becomes better understood by reference to the following detailed description when considered in connection with the accompanying drawings.

DETAILED DESCRIPTION OF THE INVENTION

One embodiment of a squeegee assembly to be used in a scrubber according to the present invention will now be described in detail with reference to the accompanying drawings.

Figure 1:
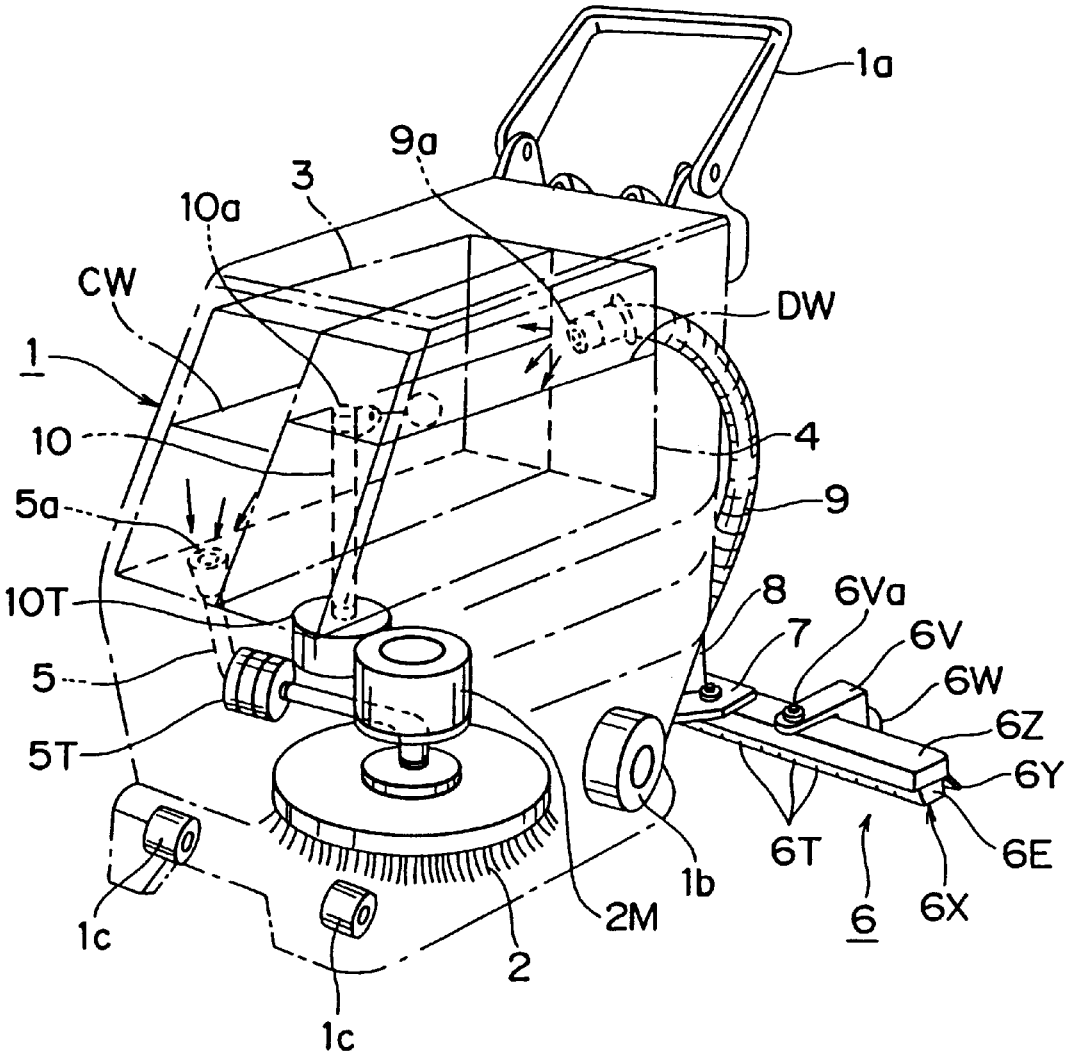
FIG. 1 is a perspective view showing, in a see-through manner, an internal construction of a scrubber equipped with a squeegee assembly according to the present invention.

FIG. 1 is a perspective view for explaining an internal construction of a scrubber incorporated with a squeegee assembly according to the present invention. In the illustration, reference numeral 1 denotes a machine body of the scrubber; 1*a,* a handle for operation; 1*b* and 1*c,* driving wheels and front wheels; 2, a rotatable brush which is rotated for brushing the floor surface by a motor 2M; 3 and 4, a tank for a cleaning liquid or cleansing liquid CW and a tank for a dirty liquid DW loaded in the machine body 1; and 5, a feed liquid tube for feeding the cleaning liquid or cleansing liquid CW coming through an inlet port 5*a* under the effect of a pump 5T to the rotatable brush 2, respectively.

Generally denoted by reference numeral 6 is a squeegee assembly according to the present invention. A sucking force of a blower 10T to be acted on the interior of the dirty liquid tank 4 through a suction tube 10 is prevailed on the interior of the squeegee assembly 6 which is connected to a rear portion of the machine body 1 from a distal end port 9*a*. With this sucking force, the dirty liquid remaining on the floor surface is sucked for collection into the dirty liquid tank 4 by means of rotational cleaning operation of the rotatable brush 2 through the vacuum hose 9. The suction tube 10 is provided at its upper end with a suction port 10*a* with a float valve.

Also, in the illustration, reference numeral 7 denotes a connection plate for connecting the squeegee assembly 6 to a rear portion of the machine body 1. Reference numeral 6Z denotes a laterally elongated case body constituting the squeegee assembly 6, with a lower end port of the vacuum hose 9 being connected to an air ventilating sleeve 8 projecting from a central area of an upper surface of the case body 6Z. The arrangement is such that the sucking force of the blower 10T is prevailed on the interior of the case body 6Z.

Figure 2:
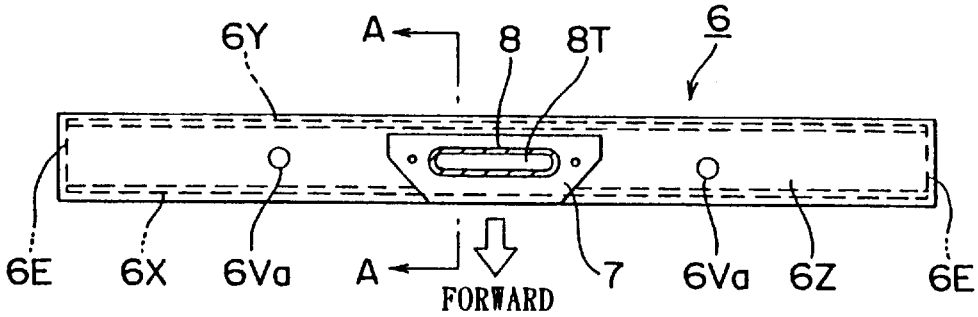
FIG. 2 is a plan view, partly in section, of the squeegee assembly for a scrubber according to the present invention.
Figure 3:
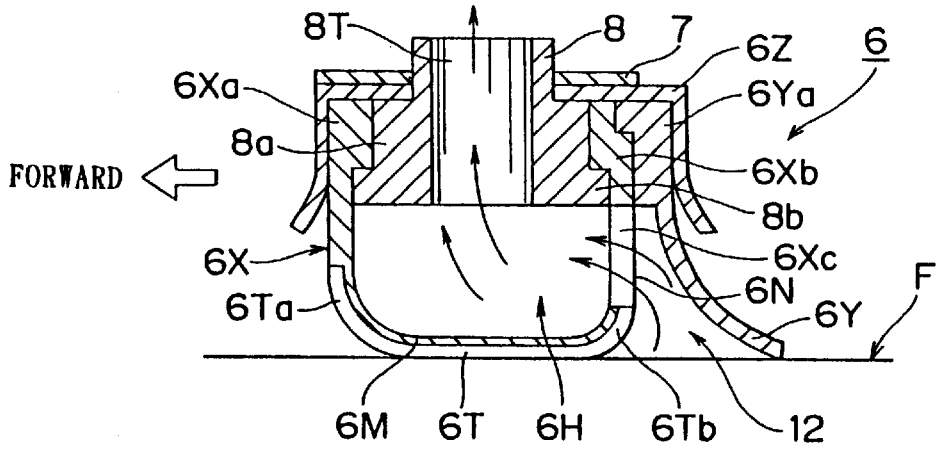
FIG. 3 is an enlarged sectional view taken on line A—A of FIG. 2.

FIG. 2 is a plan view showing an overall picture of the squeegee assembly 6, and FIG. 3 is an enlarged sectional view taken on line A—A of FIG. 2. In the Figures, reference numeral 8T denotes an sucking air ventilating port provided inside the air ventilating sleeve 8; 8*a,* 8*b,* a front and a rear holder integral with a root portion of the air ventilating sleeve 8; and 6X, 6Y, a front and a rear flexible blade (rubber plate) spacedly attached to a lower side of the inside of the case body 6Z by clamping holding portions 6Xa, 6Xb provided on an upper end portion of the squeegee assembly 6 between the front and rear holders 8*a,* 8*b* and the cover at its front and rear parts of the case body 6Z.

Of the front and rear flexible blades 6X, 6Y, the rear side flexible blade 6Y has a general configuration as the conventional blade but the front side flexible blade 6X has a special configuration. As best shown in the sectional configuration of FIG. 3, a lower side portion of the front side flexible blade 6X is once bent horizontally towards the rear side flexible blade 6Y to form a contacting surface 6M which can contact at its wide area the floor surface, and a distal end side of the contacting surface 6M is bent and raised upwardly with a small space 12 formed between the rear side flexible blade 6Y and the front side flexible blade 6X, thereby forming a raised portion 6N. The clamping holding portion 6Xb connected to a distal end side of the raised portion 6N is sandwiched between the holder 8*b* of the air ventilating sleeve 8 and the holding portion 6Ya of the rear side flexible blade 6Y. A suction chamber 6H is defined, by the front side flexible blade 6X having such a special configuration, at a lower side within the case body 6Z. The suction chamber 6H is communicated with the air ventilating port 8T.

Figure 4:
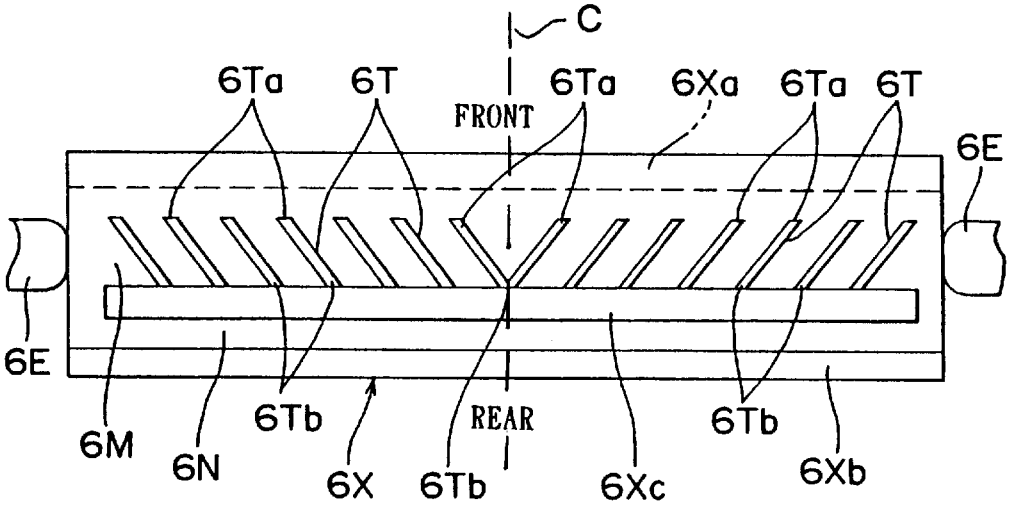
FIG. 4 is a bottom surface view showing a construction of a front side flexible blade to be used in the squeegee of FIG. 2.

FIG. 4 is a view of the front side flexible blade 6X having the above special configuration. In FIGS. 4 and 3 clearly showing a construction of the squeegee 6, reference numeral 6Xc denotes a dirty liquid sucking cavity formed at the raised portion 6N and extending laterally; 6E, a left and a right closure plate closing a left and right opening of the suction chamber 6H; 6T, a plurality of concave or wedge shaped guide grooves formed in a bottom surface of the contacting surface 6M in such a manner as to extend in a forward and backward direction with an interval formed in a lateral direction; and 6Ta, 6Tb, a plurality of forward end ports and rearward end ports formed in the guide grooves 6T, respectively. The rearward end ports 6Tb are opened at the dirty liquid sucking cavity 6Xc, respectively. The entire guide grooves 6T are inclined or slanted relative to a centerline C of the dirty liquid sucking cavity 6Xc.

Therefore, according to the squeegee assembly thus constructed for a scrubber of the present invention, the sucking force of the blower 10T prevailed on the interior of the suction chamber 6H through the vacuum hose 9 and then through the air ventilating port 8T of the air ventilating sleeve 8 further prevails on the small space 12 between the raised portion 6N and the rear side flexible blade 6Y through the dirty liquid cavity 6Xc. Accordingly, the air sucking speed is extremely fast, and a powerful sucking force can be prevailed on the floor surface F side.

Further, the wide contacting surface 6M of the front side flexible blade 6X with respect to the floor surface F is formed with the plural guide grooves 6T in which the rearward end ports 6Tb are opened toward or communicate with dirty liquid sucking cavity 6Xc formed at raised portion 6N of front side flexible blade 6X. Accordingly, the squeegee assembly 6 proceeding in the direction as indicated by an arrow of FIGS. 2 and 3 guides the dirty liquid remaining on the floor surface F towards the small space 12 between the rear side flexible blade 6Y and the raised portion 6N along the guide grooves 6T, so that the dirty liquid can be collected into the dirty liquid tank 4 from the air ventilating port 8T through the dirty liquid sucking cavity 6Xc and the suction chamber 6H by the powerful force of the blower 5T acting on the space 12.

Furthermore, according to the squeegee assembly for a scrubber of the present invention, the concave guide grooves 6T formed in the bottom surface of the contacting surface 6 are inclined or slanted towards the central line C as shown in FIG. 4. Accordingly, since the dirty liquid remaining on the floor surface F is guided towards the central portion of the squeegee 6, i.e., towards the central air ventilating port 8T where the sucking force of the blower 5T prevails, the dirty liquid can efficiently be sucked in a concentrated manner.

Figure 5:
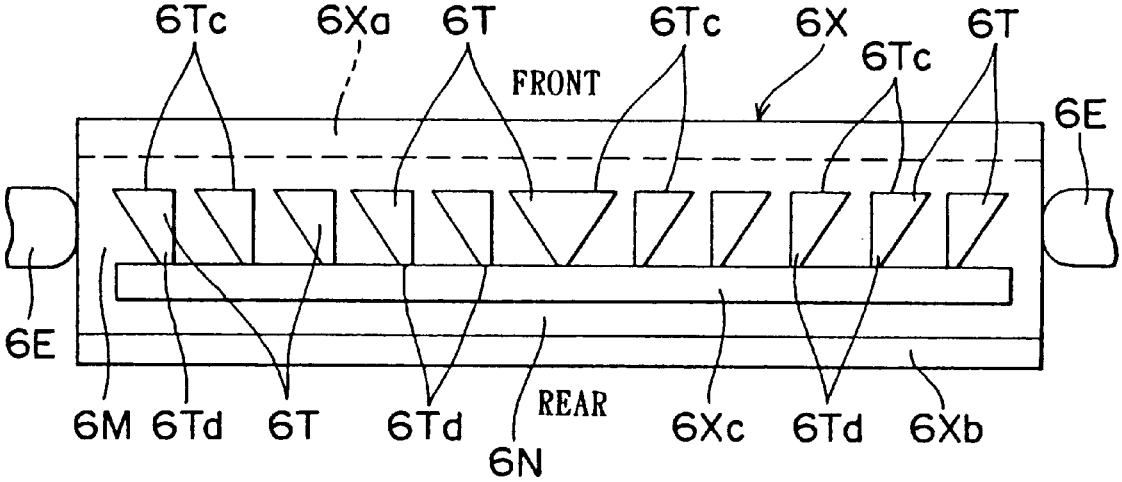
FIG. 5 is a bottom surface view showing another example of a construction of a front side flexible blade to be used in the squeegee of FIG. 2.
Figure 6:
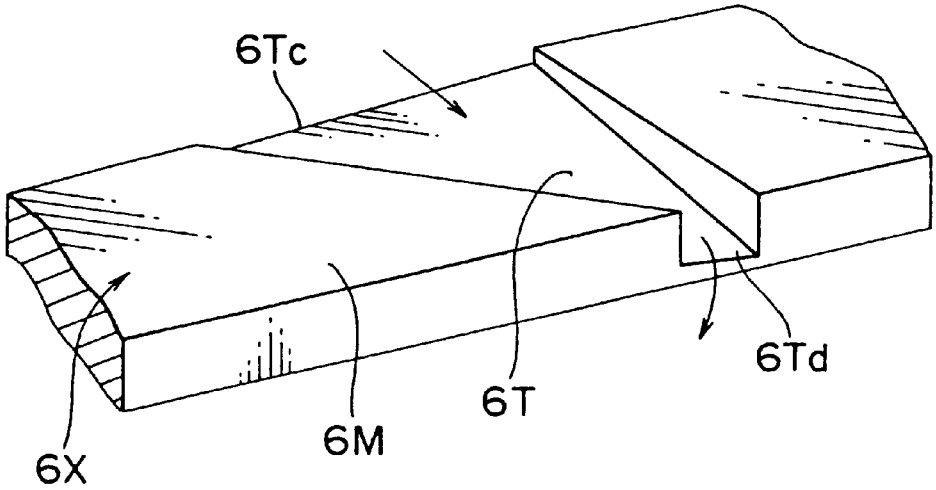
FIG. 6 is a perspective view showing a main portion of the front side flexible blade of FIG. 5 on an enlarged scale.

FIG. 5 is a view for explaining a construction of the front side flexible blade 6X to be used in the squeegee assembly 6 of the present invention, and FIG. 6 is a perspective view showing a main portion of the front side flexible blade 6X to be used in the squeegee assembly 6 of the present invention on an enlarged scale. In those Figures, the concave or wedge-shaped guide grooves 6T formed in the bottom surface of the contacting surface 6M are each formed in a generally rectangular configuration which is increased in width at the forward end ports 6Tc side and decreased in the rearward end ports side, so that the dirty liquid remaining on the floor surface F can easily be flown from the forward end ports Tc side and the forward end ports 6Tc will not be choked with dusts, hair, etc.

As shown in FIG. 6, each guide groove 6T is shallow on the forward port 6Tc side where the width is enlarged, and deep on the rearward end port 6Td side where the width is reduced, so that each guide groove 6T becomes the same in overall sectional area. Owing to this arrangement, the flowing speed of the dirty liquid flowing through the interior of each guide groove 6T is the same at the inlet port as at the outlet port. As a consequence, the sucking efficiency can be increased without increasing sucking resistance.

Figure 7:
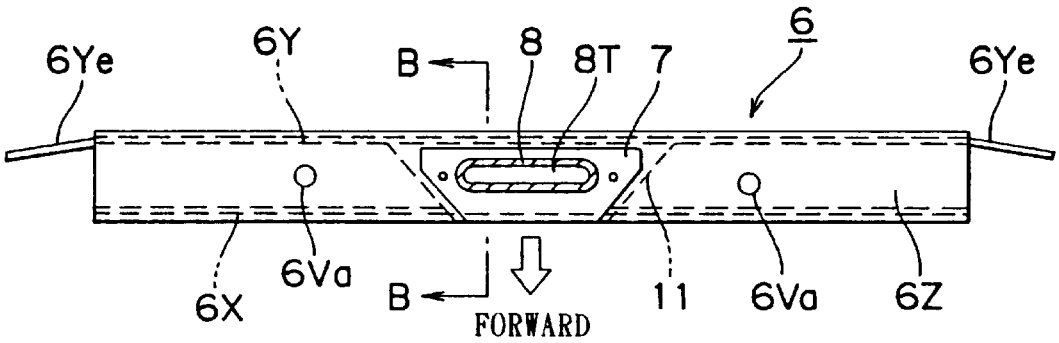
FIG. 7 is a plan view, partly section, for explaining another example of a construction of a squeegee assembly for a scrubber according to the present invention.
Figure 8:
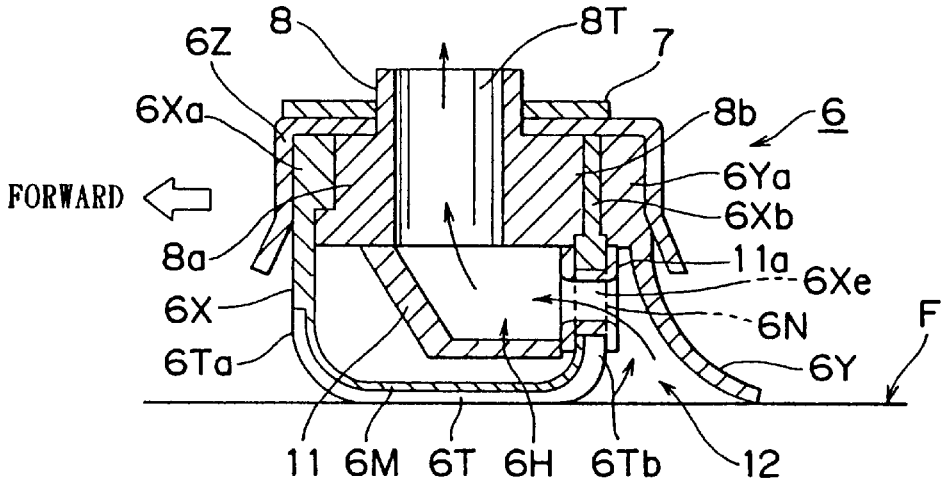
FIG. 8 is an enlarged sectional view taken on line B—B of FIG. 7.
Figure 9:
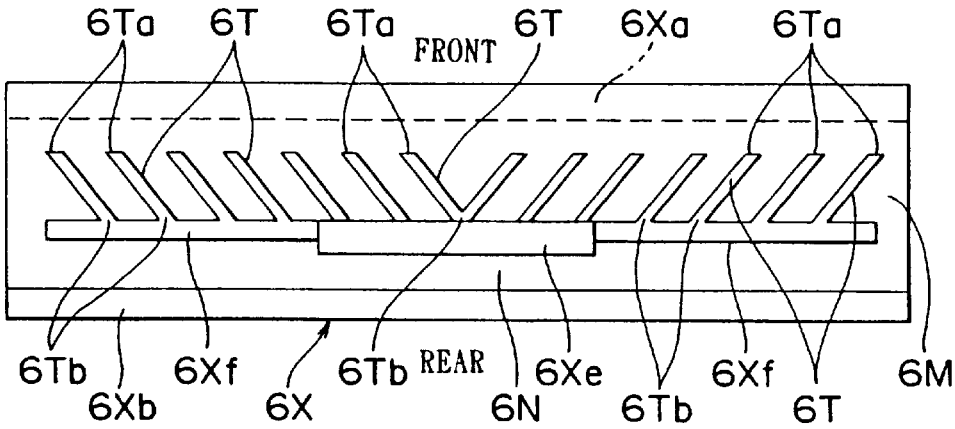
FIG. 9 is a bottom view for explaining a construction of the front side flexible blade to be used in the squeegee of FIG. 7.

FIG. 7 is a plan view for explaining a construction of the squeegee assembly 6 and FIG. 8 is an enlarged sectional view taken on line B—B of FIG. 7, of the present invention. FIG. 9 is a view for explaining a construction of the front side flexible blade 6 to be used in the squeegee 6 of FIGS. 7 and 8. According to the invention, a laterally elongated dirty liquid sucking cavity 6Xe is formed in the central portion of the front side flexible blade 6X. Rearward end ports 6Tb of a plurality of concave or wedge-shaped guide grooves 6T, which are inclined towards the central portion of the contacting surface 6M, are opened in or communicate with the sucking cavity 6Xe and in laterally elongated concave or wedge-shaped collecting grooves 6Xf which are continuous with opposite left and right sides of the sucking cavity 6Xe. Owing to this arrangement, the dirty liquid remaining on the floor surface F can be sucked towards the dirty liquid sucking cavity 6Xe at the central portion in a concentrated manner.

Within the suction chamber 6H defined by the front side flexible blade 6X as previously described, as shown in FIG. 8, a guide plate 11 is provided such that the sucking force of the blower 5T acting on the interior of the sucking chamber 6H through the air ventilating port 8T is guided towards the dirty liquid sucking cavity 6Xe of the central portion in a concentrated manner. Owing to this arrangement, the sucking force of the blower 5T is prevailed on the small space 12 through the dirty liquid sucking cavity 6Xe (actually, a seal 11*a* is fitted to its inner edge as shown in FIG. 8).

Figure 10:
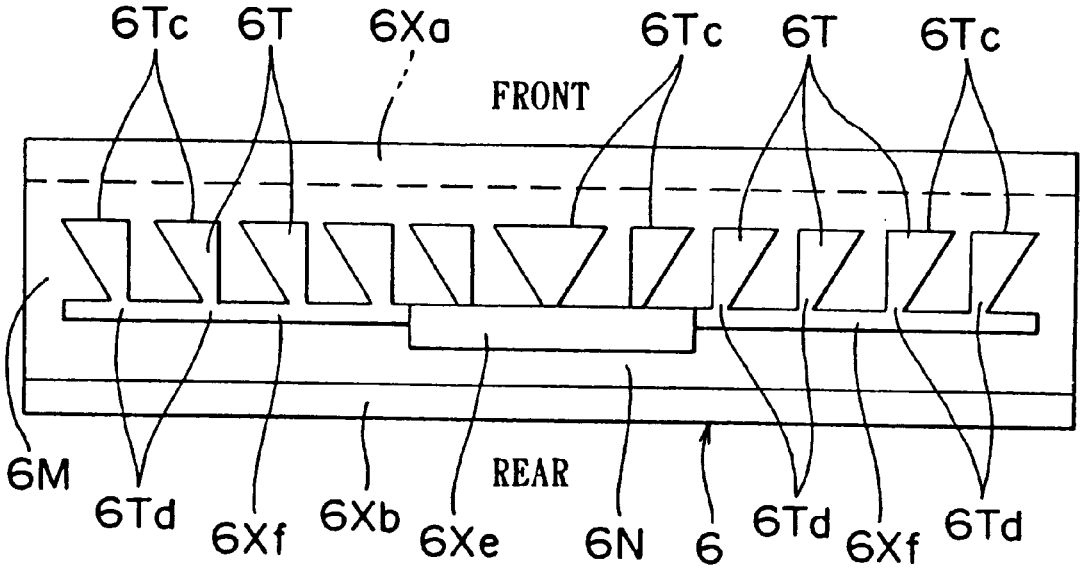
FIG. 10 is a bottom view for explaining a construction of another example of the front side flexible blade to be used in the squeegee of FIG. 7.

In FIGS. 3 through 5 and in FIGS. 8 through 10, the dirty liquid sucking cavity 6Xc, 6Xe is formed in an intermediate location (namely, a location slightly upwardly away from the floor surface F) of the raised portion 6N of the front side flexible blade 6X. However, the dirty liquid sucking cavity 6Xc, 6Xe may be formed at a location near the floor surface F, at a location contacting with the floor surface F, or at a location more upwardly away from the floor surface F than the location shown in the illustration. The location of the dirty liquid sucking cavity can freely be selected in accordance with necessity.

FIG. 10 is a developed view of the front side flexible blade 6X for explaining a construction of the squeegee assembly 6 of the present invention. Since the specific construction is the same as that of FIGS. 5 and 6, description thereof is omitted.

In FIG. 1, reference numeral 6V denotes guide wheel covers turnably supported by support shafts 6Va projecting from left and right parts of the upper surface of the cover body 6Z, and reference numeral 6W denotes guide wheels of the squeegee assembly 6 attached respectively to the covers 6V. In FIG. 7, reference numeral 6Ye denotes external end portions of the rear side flexible blade 6Y projecting from left and right opposite end ports of the cover body 6Z.

Figure 11:
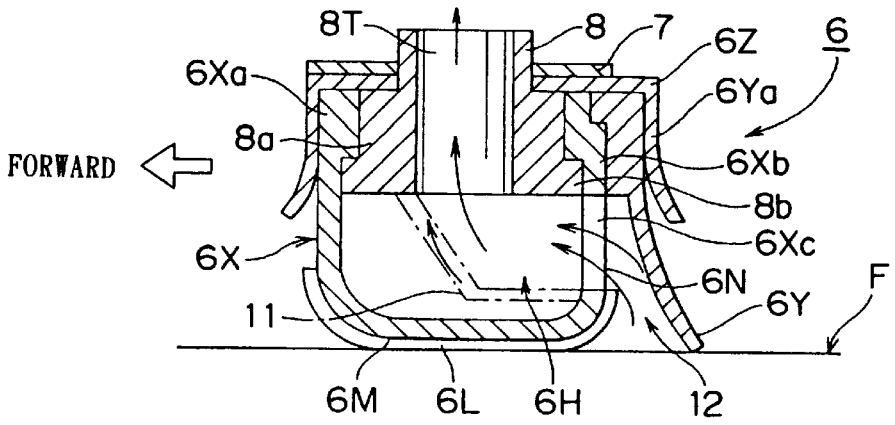
FIG. 11 is an enlarged sectional view for explaining another example of a construction of a squeegee assembly for a scrubber according to the present invention.
Figure 14:
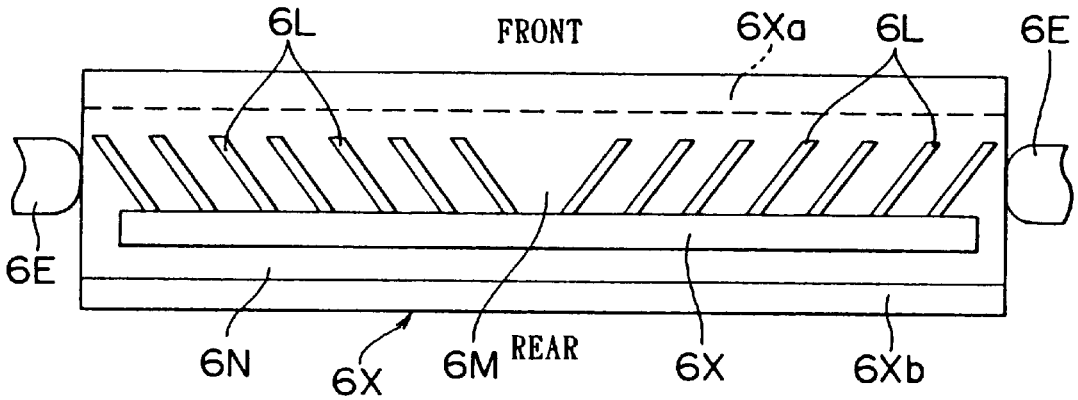
FIG. 14 is a bottom view showing a construction of a front side flexible blade to be used in the squeegee assembly of FIG. 11.

FIG. 11 is an enlarged sectional view for explaining a construction of the squeegee assembly 6, and FIG. 14 is a developed view of the front side flexible blade 6X, of the present invention. Here, instead of the guide grooves 6T of FIGS. 3 and 4, there are provided a plurality of elongated guide ridges 6L spacedly arranged on the bottom contacting surface 6M of the front side flexible blade 6X in parallel relation in a lateral direction and inclined or slanted towards the center line of the dirty liquid sucking cavity 6Xc. Owing to this arrangement, the dirty liquid remaining on the floor surface F is guided by the guide ridges 6L so as to be sucked towards the central portion of the dirty liquid sucking cavity 6Xc in a concentrated manner.

Figure 12:
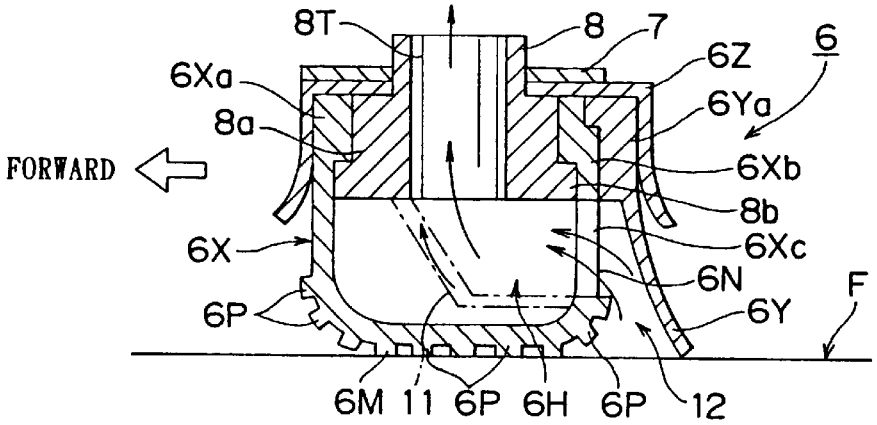
FIG. 12 is, likewise, an enlarged sectional view for explaining a further example of a construction of the squeegee assembly.
Figure 15:
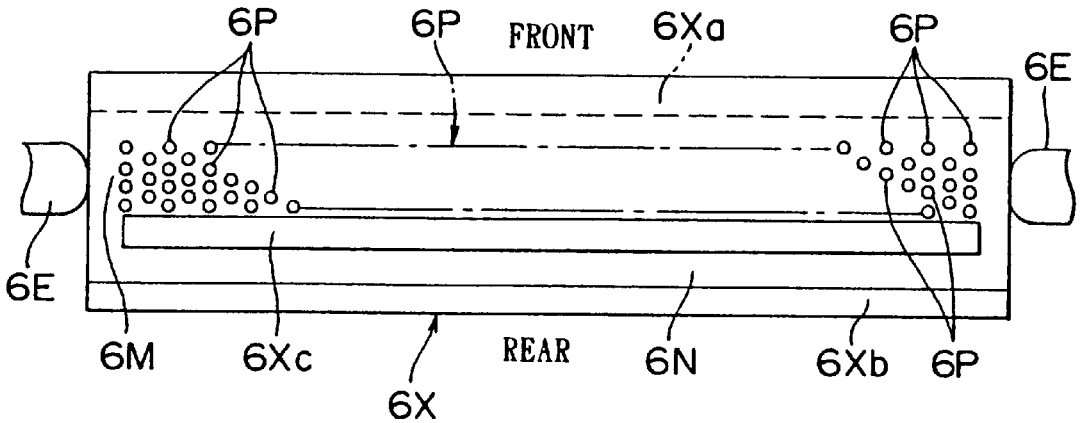
FIG. 15 is a bottom view showing a construction of a front side flexible blade to be used in the squeegee assembly of FIG. 12.

FIG. 12 is an enlarged sectional view for explaining a construction of the squeegee assembly 6, and FIG. 15 is a view of the front side flexible blade 6X, of the present invention. Here, instead of the guide grooves 6T or the guide ridges 6L, there are provided a plurality of protrusions 6P spacedly arranged on the bottom contacting surface 6M of the front side flexible blade 6X in both vertical and lateral directions. Owing to this arrangement, the dirty liquid remaining on the floor surface F is sucked towards the dirty liquid sucking cavity 6Xc through spaces among the protrusions 6P.

Figure 13:
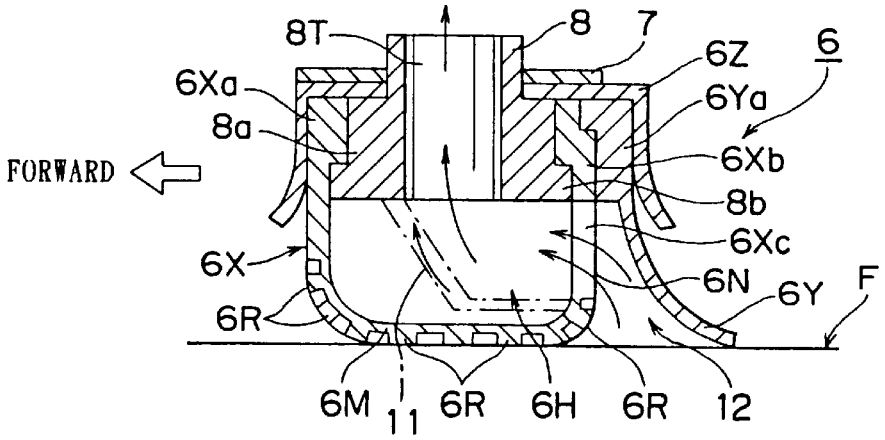
FIG. 13 is, likewise, an enlarged sectional view for explaining a still further example of a construction of the squeegee assembly.
Figure 16:
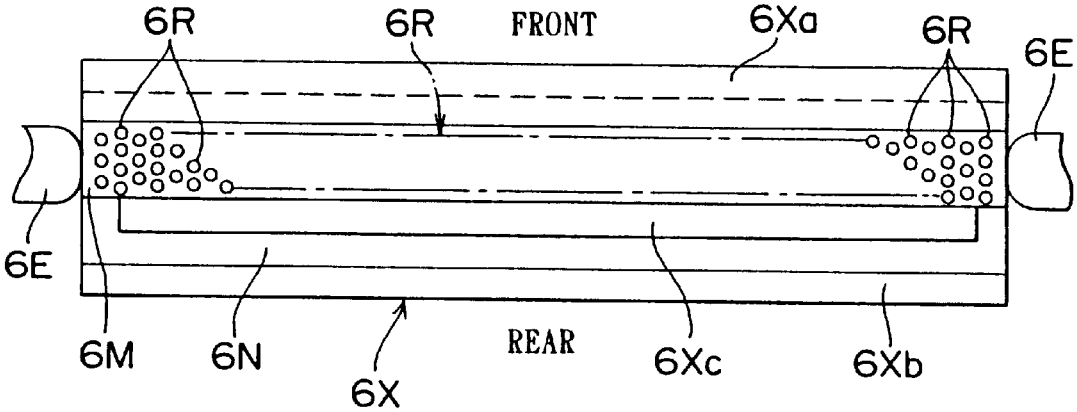
FIG. 16 is a bottom view showing a construction of a front side flexible blade to be used in the squeegee assembly of FIG. 13.
Figure 17:
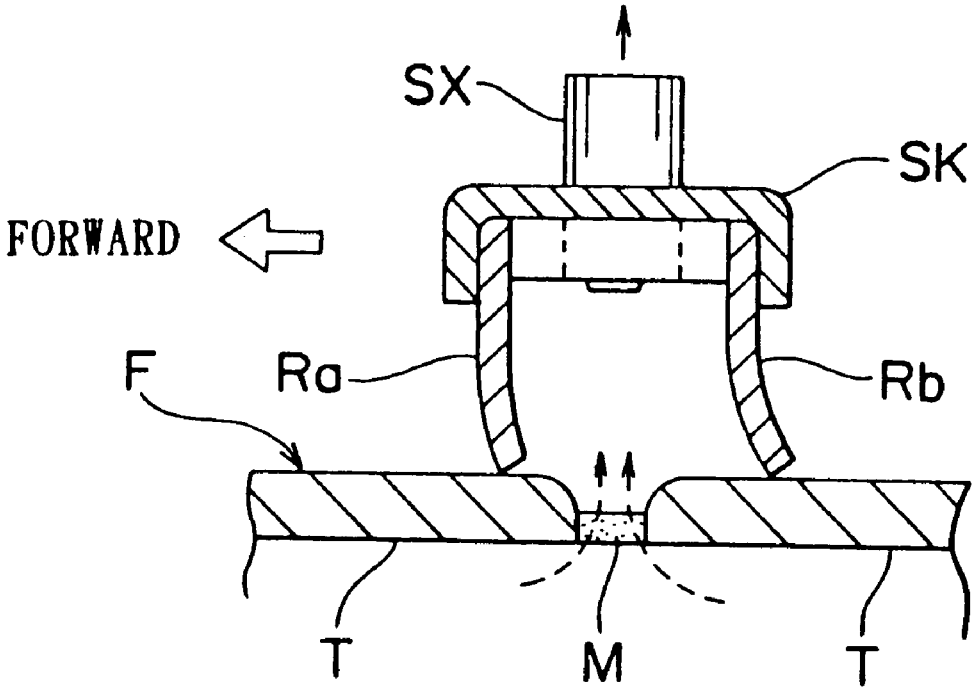
FIG. 17 is a sectional view for explaining a construction of a conventional general squeegee assembly.

FIG. 13 is an enlarged sectional view for explaining a construction of the squeegee 6, and FIG. 16 is a developed view of the front side flexible blade 6X, of the present invention. The construction of this example is generally the same as that of FIGS. 12 and 15, except that the protrusions 6R are formed by recessing the nearby areas of the protrusions 6R.

In FIGS. 11 through 13, a member indicated by an imaginary line and denoted by reference numeral 11 is a guide plate for guiding the sucking force of the blower 5T towards the dirty liquid sucking cavity 6Xc in a concentrated manner. Here, the guide plate 11 is the same member as that of FIG. 8 and exhibits the same function.

As described hereinbefore, according to a squeegee assembly for a scrubber of the present invention, an opposing space between the front and rear flexible blades is reduced to increase the sucking effect of the blower, the time of the front side flexible blade for contacting the floor surface (dirty liquid) is long enough, and the sealing performance with respect to the floor surface is increased. Owing to this feature, since an extremely powerful sucking effect can be prevailed on the floor surface for a comparatively long time, not only the dirty liquid remained on the floor surface but also the dirty liquid remaining in the joint portion between the adjacent tiles can be completely sucked.

Obviously, numerous modifications and variations of the present invention are possible in light of the above teachings. It is therefore to be understood that within the scope of the appended claims, the invention may be practiced otherwise than as specifically described herein.

What is claimed is:

1. A squeegee assembly for a scrubber, said assembly comprising:

(a) an elongated cover body;

(b) a flexible front blade;

(c) a flexible rear blade, said front and rear blades being spacedly arranged in parallel relation on said cover body to define a space between said front and rear blades; and (d) a blower for applying a sucking function to said space to suck up from within said space a dirty liquid gathered by said front and rear blades from a floor surface, said front blade having (i) a lower side portion bent horizontally toward said rear blade to form a horizontally bent floor contacting surface and (ii) a distal end side which forms a raised portion to define an opposing space between said rear blade and said raised portion of said front blade, said raised portion being secured to said cover body, said front blade and a lower side of said cover body defining a suction chamber, said sucking function of said blower being applied to said suction chamber, said horizontally bent contacting surface having a bottom surface in which a plurality of guide grooves are formed, and said raised portion having formed therein a dirty liquid sucking cavity for intercommunicating said suction chamber and said opposing space.

2. A squeegee assembly for a scrubber as in claim 1, wherein said cover body has a portion including an air port on which said sucking function of said blower is applied, and said guide grooves are slanted toward a center line of said dirty liquid sucking cavity and include rearward end ports which are in communication with said dirty liquid sucking cavity.

* * * * *